US007108062B2

(12) United States Patent
Castano-Mears et al.

(10) Patent No.: US 7,108,062 B2
(45) Date of Patent: Sep. 19, 2006

(54) EXPANDABLE WELL SCREEN

(75) Inventors: Ana M. Castano-Mears, Coppell, TX (US); John C. Gano, Carrollton, TX (US); Ralph H. Echols, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 442 days.

(21) Appl. No.: 10/147,652

(22) Filed: May 17, 2002

(65) Prior Publication Data

US 2002/0129935 A1 Sep. 19, 2002

Related U.S. Application Data

(62) Division of application No. 09/565,899, filed on May 5, 2000, now Pat. No. 6,457,518.

(51) Int. Cl.
*E21B 43/10* (2006.01)

(52) U.S. Cl. ..... 166/227; 166/236
(58) Field of Classification Search ..... 166/227–236, 166/207
See application file for complete search history.

(56) References Cited

U.S. PATENT DOCUMENTS

| | | | |
|---|---|---|---|
| 1,500,829 | A | 7/1924 | Layne |
| 1,880,218 | A | 10/1932 | Simmons |
| 2,512,226 | A | 6/1950 | Edwards |
| 2,835,328 | A | 5/1958 | Thompson |
| 2,911,047 | A | 11/1959 | Henderson |
| 2,933,137 | A | 4/1960 | D'Audiffret et al. |
| 2,990,017 | A | 6/1961 | Powers |
| 3,028,915 | A | 4/1962 | Jennings |
| 3,099,318 | A | 7/1963 | Miller et al. |
| 3,167,122 | A | 1/1965 | Lang |
| 3,179,168 | A | 4/1965 | Vincent |
| 3,203,451 | A | 8/1965 | Vincent |
| 3,203,483 | A | 8/1965 | Vincent |
| 3,297,092 | A | 1/1967 | Jennings |
| 3,353,599 | A | 11/1967 | Swift |
| 3,477,506 | A | 11/1969 | Malone |
| 3,502,145 | A | 3/1970 | Du Mee et al. |
| 3,625,892 | A | 12/1971 | Watanabe |
| 3,712,373 | A | 1/1973 | Bearden et al. |
| 3,721,297 | A | 3/1973 | Challacombe |

(Continued)

FOREIGN PATENT DOCUMENTS

| | | |
|---|---|---|
| EP | 0 674 095 A2 | 9/1995 |
| EP | 0 643 794 B1 | 11/1996 |
| EP | 0 643 795 B1 | 11/1996 |

(Continued)

OTHER PUBLICATIONS

Search Report for European Patent Application No. EP 01 304 042.
Enventure Expandable Tubular Technology Brochure, dated 1998.
Petroline Ess Products; General Information Brochure, dated Nov.1998.

(Continued)

*Primary Examiner*—William Neuder
(74) *Attorney, Agent, or Firm*—Marlin R. Smith; J. Richard Konneker

(57) ABSTRACT

An expandable well screen provides increased collapse, torsional and tensile strength. In a described embodiment, an expandable well screen includes a generally tubular base pipe and an external filtering media. The well screen is configured to have sufficient torsional and tensile strength for conveyance and positioning in a wellbore, while also having sufficient strength to prevent collapse when the screen is radially expanded.

20 Claims, 12 Drawing Sheets

U.S. PATENT DOCUMENTS

| | | | | | |
|---|---|---|---|---|---|
| 3,734,179 | A | | 5/1973 | Smedley | |
| 3,899,631 | A | | 8/1975 | Clark | |
| 4,200,150 | A | * | 4/1980 | Saadeh et al. | 166/231 |
| 4,683,944 | A | | 8/1987 | Curlett | |
| 5,008,664 | A | | 4/1991 | More et al. | |
| 5,083,608 | A | | 1/1992 | Abdrakhmanov et al. | |
| 5,183,115 | A | | 2/1993 | Gano | |
| 5,318,698 | A | | 6/1994 | Bernhardt | |
| 5,348,095 | A | | 9/1994 | Worrall et al. | |
| 5,366,012 | A | | 11/1994 | Lohbeck | |
| 5,388,648 | A | | 2/1995 | Jordan, Jr. | |
| 5,390,742 | A | * | 2/1995 | Dines et al. | 166/297 |
| 5,392,862 | A | | 2/1995 | Swearingen | |
| 5,404,954 | A | | 4/1995 | Whitebay et al. | |
| 5,425,559 | A | | 6/1995 | Nobileau | |
| 5,460,416 | A | | 10/1995 | Freidrich et al. | |
| 5,515,915 | A | | 5/1996 | Jones et al. | |
| 5,622,211 | A | | 4/1997 | Martin et al. | |
| 5,667,011 | A | | 9/1997 | Gill et al. | |
| 5,695,008 | A | | 12/1997 | Bertet et al. | |
| 5,718,288 | A | | 2/1998 | Bertet et al. | |
| 5,765,756 | A | | 6/1998 | Jordan et al. | |
| 5,794,702 | A | | 8/1998 | Nobileau | |
| 5,829,520 | A | | 11/1998 | Johnson | |
| 5,842,516 | A | | 12/1998 | Jones | |
| 5,855,242 | A | | 1/1999 | Johnson | |
| 5,868,200 | A | | 2/1999 | Bryant et al. | |
| 5,892,860 | A | | 4/1999 | Maron et al. | |
| 5,901,789 | A | | 5/1999 | Donnelly et al. | |
| 5,924,745 | A | | 7/1999 | Campbell | |
| 5,964,296 | A | | 10/1999 | Ross | |
| 5,971,072 | A | | 10/1999 | Huber et al. | |
| 5,984,568 | A | | 11/1999 | Lohbeck | |
| 6,006,829 | A | | 12/1999 | Whitlock et al. | |
| 6,012,522 | A | | 1/2000 | Donnelly et al. | |
| 6,012,523 | A | | 1/2000 | Campbell et al. | |
| 6,021,850 | A | | 2/2000 | Wood et al. | |
| 6,029,748 | A | | 2/2000 | Forsyth et al. | |
| 6,044,906 | A | | 4/2000 | Saltel | |
| 6,065,540 | A | | 5/2000 | Thomeer et al. | |
| 6,082,454 | A | | 7/2000 | Tubel | |
| 6,148,915 | A | | 11/2000 | Mullen et al. | |
| 6,173,788 | B1 | | 1/2001 | Lembcke et al. | |
| 6,176,323 | B1 | | 1/2001 | Weirich et al. | |
| 6,227,303 | B1 | | 5/2001 | Jones | |
| 6,263,966 | B1 | * | 7/2001 | Haut et al. | 166/278 |
| 6,263,972 | B1 | | 7/2001 | Richard et al. | |
| 6,269,883 | B1 | | 8/2001 | Gissler et al. | |
| 6,273,195 | B1 | | 8/2001 | Hauck et al. | |
| 6,281,489 | B1 | | 8/2001 | Tubel et al. | |
| 6,298,917 | B1 | | 10/2001 | Kobylinski et al. | |
| 6,328,113 | B1 | | 12/2001 | Cook | |
| 6,347,666 | B1 | * | 2/2002 | Langseth | 166/252.1 |
| 6,457,518 | B1 | | 10/2002 | Castano-Mears et al. | |
| 6,478,091 | B1 | * | 11/2002 | Gano | 166/373 |
| 6,505,682 | B1 | | 1/2003 | Brockman | |
| 6,554,064 | B1 | | 4/2003 | Restarick et al. | |
| 6,681,854 | B1 | | 1/2004 | Danos | |
| 6,684,951 | B1 | | 2/2004 | Restarick et al. | |
| 6,817,410 | B1 | | 11/2004 | Wetzel et al. | |
| 2002/0007948 | A1 | | 1/2002 | Bayne et al. | |
| 2002/0053439 | A1 | | 5/2002 | Danos | |
| 2002/0129935 | A1 | | 9/2002 | Castano-Mears et al. | |
| 2003/0085038 | A1 | | 5/2003 | Restarick et al. | |

FOREIGN PATENT DOCUMENTS

| | | |
|---|---|---|
| EP | 0 795 679 A2 | 9/1997 |
| EP | 0 824 628 A B1 | 12/1998 |
| FR | 2771133 | 5/1999 |
| GB | 2 336 383 | 10/1999 |
| WO | WO 93/25799 | 12/1993 |
| WO | WO 96/22452 | 7/1996 |
| WO | WO 96/37680 | 11/1996 |
| WO | WO 96/37681 | 11/1996 |
| WO | WO 97/17526 | 5/1997 |
| WO | WO 97/17527 | 5/1997 |
| WO | WO 97/21901 | 6/1997 |
| WO | WO 98/26152 | 6/1998 |
| WO | WO 98/42947 | 10/1998 |
| WO | WO 98/49423 A1 | 11/1998 |
| WO | WO 99/13195 A1 | 3/1999 |
| WO | WO 99/23354 | 5/1999 |
| WO | WO 99/56000 | 11/1999 |
| WO | WO 00/45031 A1 | 8/2000 |

OTHER PUBLICATIONS

Petroline Expandable Slotted Tube Products Brochure, undated.

Weatherford Completion Systems Expandable Sand Screen, udated.

U.S. Appl. No. 09/565,000, filed May 4, 2000.

U.S. Appl. No. 10/223,048, filed Aug. 16, 2002.

U.S. Appl. No. 09/758,625, filed Jan. 11, 2001.

U.S. Appl. No. 10/233,987, filed Sep. 3, 2002.

Partial Search Report for PCT application: PCT/US02/00156.

Office Action for U.S. Appl. No. 10/233,048 dated Jan. 12, 2004.

* cited by examiner

EXPANDABLE WELL SCREEN

CROSS-REFERENCE TO RELATED APPLICATION

The present application is a division of prior application Ser. No. 09/565,899, filed May 5, 2000, now U.S. Pat. No. 6,457,518, the entire disclosure of which is incorporated herein by this reference.

BACKGROUND OF THE INVENTION

The present invention relates generally to operations performed, and equipment utilized, in conjunction with a subterranean well and, in an embodiment described herein, more particularly provides an expandable well screen.

It is useful in some circumstances to be able to convey generally tubular equipment into a subterranean well, position the equipment within a wellbore of the well, and then outwardly expand the equipment in the wellbore. For example, a restriction in the wellbore may prevent the equipment in its expanded. configuration from passing through that part of the wellbore, but the equipment may pass through the restriction in its retracted configuration. In one application of this principle, it is known to use expandable well screens in wellbores.

An example of the potential usefulness of expandable equipment in a wellbore is where the wellbore intersects a productive, relatively unconsolidated, formation. It would be desirable in many situations to be able to utilize a well screen to filter production from the formation, while foregoing the expense of cementing casing in the wellbore and performing a gravel packing operation. Unfortunately, without any radial support the unconsolidated formation would likely collapse into the wellbore, causing additional expense and loss of revenue. Conventional nonexpandable well screens must necessarily be smaller than the wellbore in order to be conveyed therethrough, and so they are incapable of providing any radial support for an unconsolidated formation. Conventional expandable well screens are not designed for contacting and providing radial support for a formation, and so are unsuited for this purpose.

Therefore, it can be seen that it would be quite desirable to provide an expandable well screen which may be used for contacting and providing radial support for a formation intersected by a wellbore. It would also be desirable to provide an expandable well screen having enhanced torsional and tensile strength. It is accordingly an object of the present invention to provide such an expandable well screen.

SUMMARY OF THE INVENTION

In carrying out the principles of the present invention, in accordance with an embodiment thereof, an expandable well screen is provided. When radially extended downhole, the well screen may be used to support an unconsolidated formation. Of course, the well screen may also be used in situations in which a formation is not supported by the screen. Additionally, an expandable well screen having enhanced torsional and tensile strength is provided.

In one aspect of the present invention, an expandable well screen includes a generally tubular base pipe with a series of rows of holes formed through a sidewall of the base pipe, and a filtering media disposed externally on the base pipe. The holes of each row interconnect with each other, forming a larger opening, when the base pipe is expanded radially outward.

In another aspect of the present invention, an expandable well screen is provided which includes a generally tubular base pipe with a series of holes formed through a sidewall of the base pipe, and a filtering media disposed externally on the base pipe. The holes are distributed helically relative to a longitudinal axis of the base pipe. When the base pipe is expanded radially outward, each of the holes is compressed in the direction of the base pipe longitudinal axis.

In still another aspect of the present invention, an expandable well screen is provided which includes a generally tubular base pipe and an elongated strip of filtering media wrapped helically about the base pipe. The filtering media may be wrapped in multiple wraps about the base pipe, with a connection formed between adjacent wraps. The connection may be a welded seam between the wraps, or it may include a connector between the wraps. If a connector is used, various types of lines (electric, hydraulic, communication, chemical injection, etc.) may be positioned adjacent the connector.

In yet another aspect of the present invention, an expandable well screen is provided which includes a generally tubular base pipe with alternating filtering media strips and expansion strips circumferentially distributed about the base pipe. The filtering media strips and expansion strips are connected to each other so that, when the base pipe is expanded radially outward, the expansion strips lengthen circumferentially, thereby increasing the circumferential separation between the filtering media strips.

In a further aspect of the present invention, an expandable well screen is provided which includes a generally tubular base pipe and a generally tubular filtering media outwardly overlying the base pipe. The filtering media includes expansion portions which permit circumferential lengthening of the filtering media. The expansion portions may be longitudinally extending corrugations formed on the filtering media. The screen may include longitudinally extending ribs positioned between the base pipe and the filtering media, and at least one of the ribs may be positioned between the base pipe and one of the expansion portions. One or more of the ribs may be substantially hollow and may have various lines (electrical, hydraulic, communication, chemical injection, etc.) extending therethrough. The filtering media may include a series of circumferentially extending and helically arranged slots, with a width of each slot decreasing when the base pipe is expanded radially outward.

In a still further aspect of the present invention, an expandable well screen is provided which includes a generally tubular base pipe, a filtering media outwardly overlying the base pipe, a series of ribs disposed externally relative to the filtering media and a generally tubular protective shroud outwardly overlying the ribs. An expansion strip may be connected to opposite circumferential ends of the filtering media, with the expansion strip elongating circumferentially when the base pipe is radially outwardly expanded, or the filtering media may have longitudinal corrugations formed thereon which at least partially straighten when the base pipe is radially outwardly expanded.

The filtering media in the above expandable well screens may include a layer of relatively fine filtering material sandwiched between layers of relatively coarse filtering material. The relatively fine filtering material may be a sintered woven filtering material. If the filtering media includes a woven material, the material may have strands thereof which are arranged helically relative to the base pipe longitudinal axis.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1A:
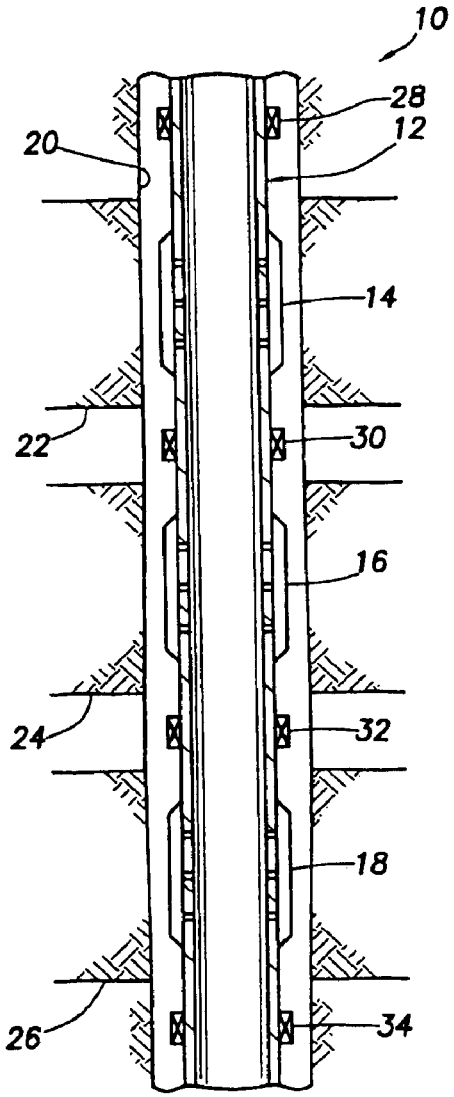
FIGS. 1A & 1B are schematic views of a method embodying principles of the present invention.

Representatively illustrated in FIGS. 1A & B is a method 10 which embodies principles of the present invention. In the following description of the method 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

Referring initially to FIG. 1A, in the method 10, a screen assembly 12 including multiple expandable well screens 14, 16, 18 is conveyed into a wellbore 20. The wellbore 20 intersects multiple formations or zones 22, 24, 26 from which it is desired to produce fluids. The screens 14, 16, 18 are positioned opposite respective ones of the zones 22, 24, 26.

The wellbore 20 is depicted in FIGS. 1A & B as being uncased, but it is to be clearly understood that the principles of the present invention may also be practiced in cased wellbores. Additionally, the screen assembly 12 is depicted as including three individual screens 14, 16, 18, with only one of the screens being positioned opposite each of the zones 22, 24, 26, but it is to be clearly understood that any number of screens may be used in the assembly, and any number of the screens may be positioned opposite any of the zones, without departing from the principles of the present invention. Thus, each of the screens 14, 16, 18 described herein and depicted in FIGS. 1A & B may represent multiple screens.

Sealing devices 28, 30, 32, 34 are interconnected in the screen assembly 12 between, and above and below, the screens 14, 16, 18. The sealing devices 28, 30, 32, 34 could be packers, in which case the packers would be set in the wellbore 20 to isolate the zones 22, 24, 26 from each other in the wellbore. However, the sealing devices 28, 30, 32, 34 are preferably expandable sealing devices, which are expanded into sealing contact with the wellbore 20 when the screen assembly 12 is expanded as described in further detail below. For example, the sealing devices 28, 30, 32, 34 may include a sealing material, such as an elastomer, a resilient material, a nonelastomer, etc., externally applied to the screen assembly 12.

Figure 1B:
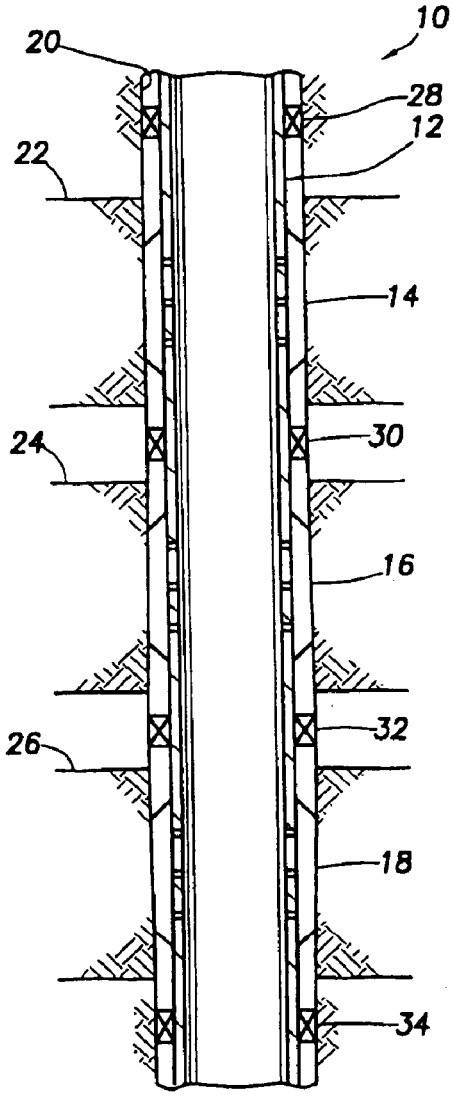

Referring additionally now to FIG. 1B, the screen assembly 12 has been expanded radially outward. The sealing devices 28, 30, 32 and 34 now sealingly engage the wellbore 20 between the screens 14, 16, 18, and above and below the screens.

Additionally, the screens 14, 16, 18 preferably contact the wellbore 20 at the zones 22, 24, 26. Such contact between the screens 14, 16, 18 and the wellbore 20 may aid in preventing formation sand from being produced, preventing the formations or zones 22, 24, 26 from collapsing into the wellbore, etc. However, this contact is not necessary in keeping with the principles of the present invention.

The use of an expandable screen assembly 12 has several additional benefits. For example, the radially reduced configuration shown in FIG. 1A may be advantageous for passing through a restriction uphole, and the radially expanded configuration shown in FIG. 1B may be advantageous for providing a large flow area and enhanced access therethrough. However, the expandable screen assembly 12 must have sufficient torsional and tensile strength so that it is not damaged while being conveyed and positioned in the wellbore 20 and, if the screens 14, 16, 18 are to be expanded into contact with the zones 22, 24, 26 for radial support thereof, the screens must have sufficient collapse resistance.

Figure 2:
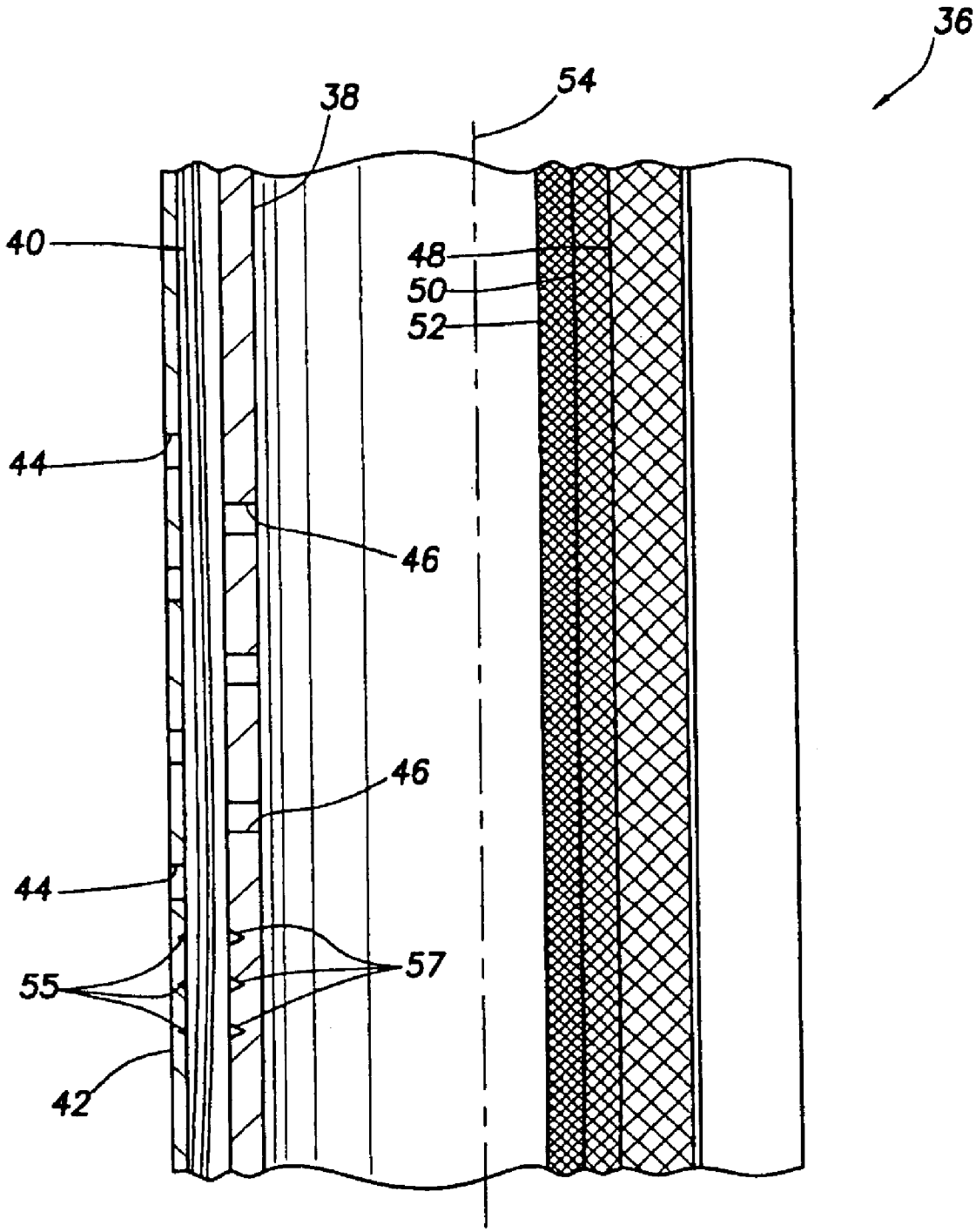
FIG. 2 is an enlarged scale partially cross-sectional and partially elevational view of a first expandable well screen embodying principles of the present invention.

Referring additionally now to FIG. 2, an expandable well screen 36 embodying principles of the present invention is representatively illustrated. The well screen 36 may be used for one or more of the well screens 14, 16, 18 in the method 10. However, it is to be clearly understood that the well screen 36 may be utilized in any other method without departing from the principles of the present invention.

The well screen 36 includes a generally tubular base pipe 38, a filtering media 40 outwardly overlying the base pipe, and a generally tubular protective outer shroud 42 outwardly overlying the filtering media. The shroud 42 has openings 44 formed through a sidewall thereof to admit fluid into the well screen 36. The fluid is filtered by passing inwardly through the filtering media 40. The fluid then flows inwardly through openings 46 formed through a sidewall of the base pipe 38.

The well screen 36 may be radially expanded utilizing any of various methods. For example, a swage may be passed through the base pipe 38, fluid pressure may be applied to a membrane positioned within the base pipe, etc. Thus, any method of expanding the well screen 36 may be used, without departing from the principles of the present invention.

The shroud 42 protects the filtering media 40 from damage while the well screen 36 is being conveyed and positioned in a well. Additionally, if the well screen 36 is used in a method, such as the method 10 described above, wherein the well screen is expanded into radial contact with a wellbore, the shroud 42 also protects the filtering media 40 from damage due to such contact, and provides radial support to prevent collapse of the wellbore. Thus, the shroud 42 is preferably constructed of a durable, deformable, high strength material, such as steel, although other materials may be used in keeping with the principles of the present invention.

It will be readily appreciated that, when the base pipe 38 is expanded radially outward, the filtering media 40 will be radially compressed between the shroud 42 and the base pipe. Because of differential expansion between the base pipe 38 and the shroud 42, it may be difficult or otherwise undesirable to maintain alignment between the openings 44 in the shroud and the openings 46 in the base pipe. This lack of alignment between the openings 44, 46 and compression of the filtering media 40 between the shroud 42 and the base pipe 38 could severely restrict the flow of fluid into the well screen 36. However, the filtering media 40 includes features which completely or substantially eliminate this potential problem.

Specifically, the filtering media 40 includes three layers of filtering material—an outer relatively coarse layer 48, a middle relatively fine layer 50, and an inner relatively coarse layer 52. The terms "fine" and "coarse" are used herein to indicate the relative size of particles permitted to pass through the filter layers 48, 50, 52. That is, the middle layer 50 filters fine or small-sized particles from fluid passing therethrough, while the inner and outer layers 48, 52 filter coarse or larger-sized particles from fluid passing therethrough.

However, the inner and outer layers 48, 52 are not necessarily used for their filtering properties, although at least the outer layer 48 will filter larger-sized particles from fluid flowing into the well screen 36. Instead, they are used primarily to provide for flow between the openings 44, 46 after the base pipe 38 is expanded. For example, if the filter layers 48, 52 are made of a relatively coarse woven material as depicted in FIG. 2, fluid may flow transversely through the layers between the shroud 42 and the base pipe 38. Thus, fluid may flow into one of the openings 44, flow transversely through the outer filter layer 48, flow inwardly through the middle filter layer 50, flow transversely through the inner filter layer 52 to one of the openings 46, and then flow inwardly through the opening 46. Therefore, even if the filtering media 40 is radially compressed between the shroud 42 and the base pipe 38, and the openings 44 are not aligned with the openings 46, fluid may still flow relatively unimpeded through the filtering media (other than the resistance to flow due to the relatively fine middle filter layer 50).

Another method of providing for transverse fluid flow between the shroud 42 and the base pipe 38 is to form grooves or recesses 55 internally on the shroud and/or grooves or recesses 57 externally on the base pipe. In this manner, either or both of the filter layers 48, 52 maybe eliminated from the filtering media 40.

Preferably the filter layers 48, 50, 52 are each made of a woven metal material, with strands thereof sintered to each other and oriented helically relative to a longitudinal axis 54 of the base pipe 38. Sintering of the strands improves the strength of the filter layers 48, 50, 52 while maintaining consistency in the spacing between the strands when the layers are radially outwardly expanded. Orienting the strands helically relative to the base pipe axis 54 aids in preventing distortion of the filter layers 48, 50, 52 when the layers are radially outwardly expanded. However, it is to be clearly understood that it is not necessary in keeping with the principles of the present invention for the filtering media 40 to be made up of multiple layers 48, 50, 52 of woven material having sintered strands oriented helically relative to the base pipe axis 54, since other types of filtering media maybe used in the well screen 36.

Note that the filtering media 40 may be stretched circumferentially when the well screen 36 is radially outwardly expanded. Preferably, this stretching of the filtering media 40 results in a change of less than fifty percent in the size of the openings for fluid flow through each of the layers 48, 50, 52. Additionally, it is preferred that the maximum size of the openings for fluid flow through the one of the layers 48, 50, 52 having the smallest mesh (i.e., the layer filtering the smallest particles from the fluid flowing therethrough) is 500 μm. Thus, after the well screen 36 is radially outwardly expanded, the filtering media 40 preferably filters particles having a size of greater than 500 μm from the fluid flowing therethrough.

Figure 3A:
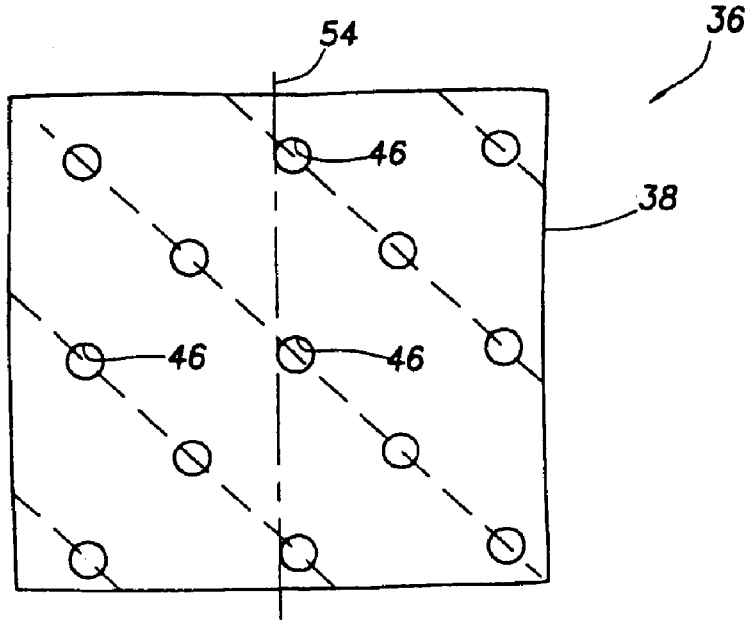
FIGS. 3A & 3B are elevational views of a base pipe of the first well screen.

Referring additionally now to FIGS.. 3A & B, an elevational view of a portion of the base pipe 38 is representatively illustrated apart from the remainder of the well screen 36. The portion of the base pipe 38 illustrated in FIGS. 3A & B is shown as if the base pipe were "unrolled" or flattened from its normal tubular form. FIG. 3A shows the portion of the base pipe 38 prior to radial expansion of the base pipe, and FIG. 3B shows the portion of the base pipe after it has been radially expanded.

In FIG. 3A it may be seen that the openings 46 are arranged helically on the base pipe 38 relative to the longitudinal axis 54. This arrangement of the openings 46 provides good hoop strength in the base pipe 38 and provides support for the filtering media 40.

Figure 3B:
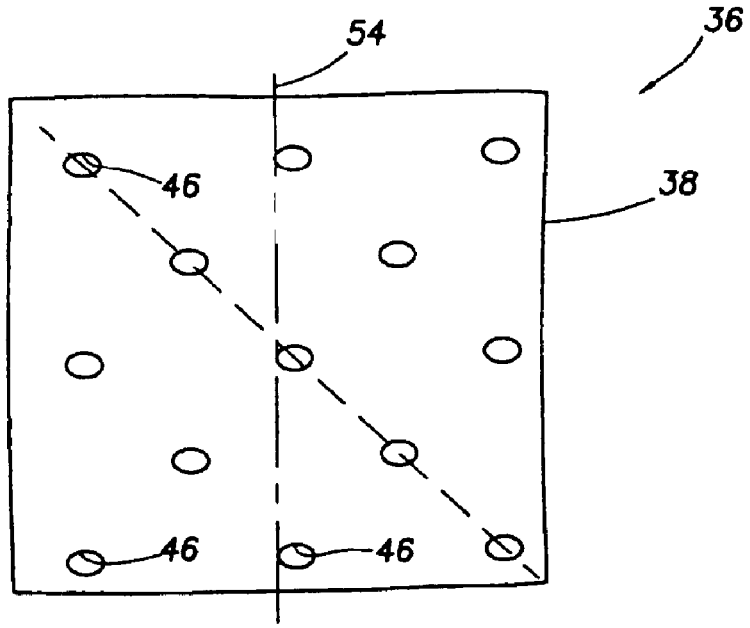

In FIG. 3B, it may be seen that the openings 46 are axially compressed when the base pipe 38 is radially extended. Some axial shortening of the base pipe 38 occurs when it is radially outwardly extended. The helical arrangement of the openings 46 relative to the base pipe longitudinal axis 54 may increase the axial shortening of the base pipe 38 while providing enhanced control over the final expanded size of the well screen 36.

Figure 4A:
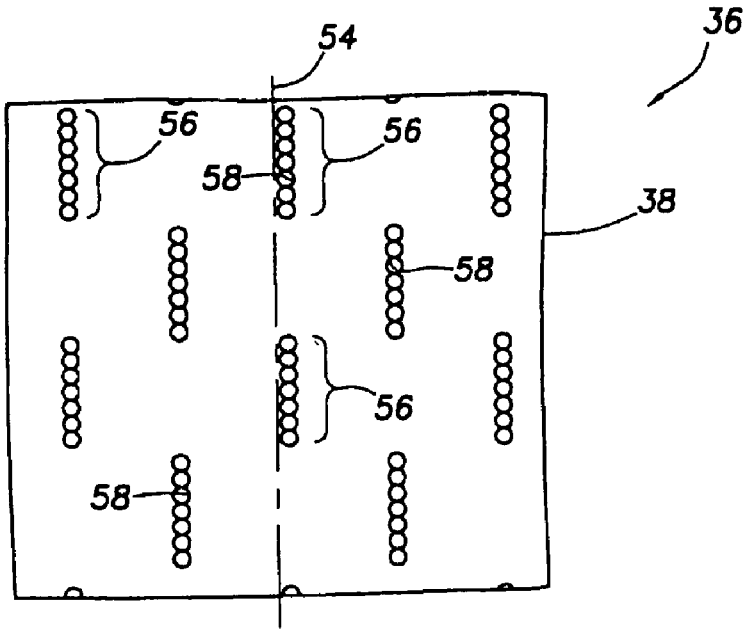
FIGS. 4A & 4B are elevational views of an alternate base pipe of the first well screen.
Figure 4B:
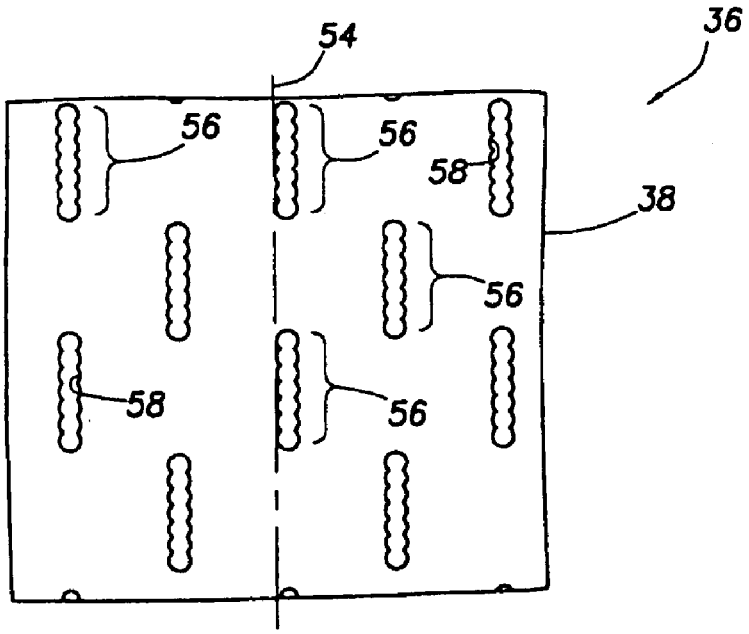

Referring additionally now to FIGS. 4A & B, the portion of the base pipe 38 is again illustrated in "unrolled" form, with FIG. 4A showing the portion of the base pipe prior to radial expansion of the base pipe, and FIG. 4B showing the portion of the base pipe after the base pipe has been radially expanded. FIGS. 4A & B depict an alternate configuration of the base pipe 38 in which the openings 46 are replaced by multiple series of rows 56 of holes 58.

The series of rows 56 are arranged helically on the base pipe 38 relative to the longitudinal axis 54, with each row extending parallel to the longitudinal axis 54. The holes 58 of each row 56 are arranged along a straight line. However, it should be clear that this helical arrangement of the series of rows 56 relative to the axis 54, the parallel relationship between each row and the axis, and the linear arrangement of the holes 58 within each row may be changed, without departing from the principles of the present invention.

By substituting the smaller holes 58 for the openings 46, the torsional and tensile strength of the base pipe 38 is enhanced. When the base pipe 38 is expanded as depicted in FIG. 4B, the holes 58 of each row 56 interconnect with each other to form larger openings. Thus, a desired final flow area through the sidewall of the base pipe 38 may be achieved after the base pipe is radially expanded, even though the desired flow area is not present before the base pipe is expanded. The helical arrangement of the series of rows 56 may also increase the axial shortening of the base pipe 38 while providing enhanced control over the final expanded size of the well screen 36.

Figure 5:
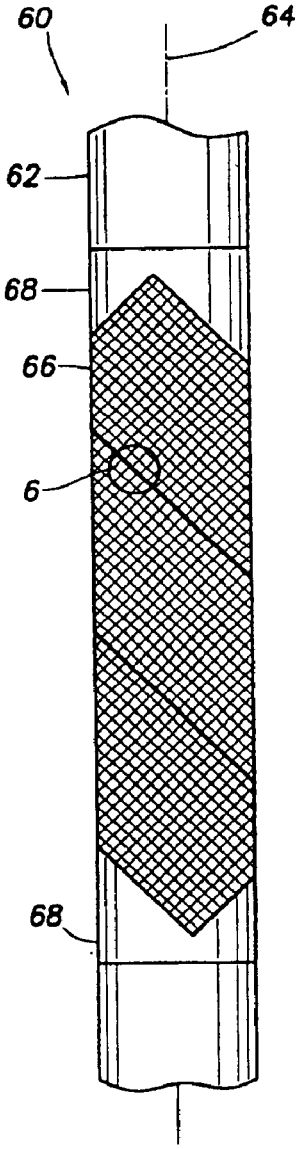
FIG. 5 is an elevational view of a second expandable well screen embodying principles of the present invention.

Referring additionally now to FIG. 5, another well screen 60 embodying principles of the present invention is representatively illustrated. The well screen 60 may be used in the method 10 described above, or it may be used in any other method, without departing from the principles of the present invention.

The well screen 60 includes a generally tubular base pipe 62 having a longitudinal axis 64, an elongated strip of filtering media 66 outwardly overlying the base pipe, and generally tubular transition members 68 used for attaching the filtering media to the base pipe. Although not shown in FIG. 5, the well screen 60 may also include a generally tubular outer shroud outwardly overlying the filtering media 66.

The filtering media 66 may be made of a similar material and may have similar layers of filtering material as the filtering media 40 described above. As depicted in FIG. 5, strands of the filtering material are oriented helically relative to the base pipe longitudinal axis 64. The filtering media 66 is itself wrapped helically about the base pipe 62 in multiple wraps.

As with the filtering media 40 described above, the filtering media 66 is circumferentially stretched when the well screen 60 is radially expanded. Preferably, the openings for fluid flow through the filtering media 66 change in size less than fifty percent, and the filtering media filters particles having a size greater 500 μm from the fluid flowing through the filtering media, when the well screen 60 is radially expanded.

Figure 6:
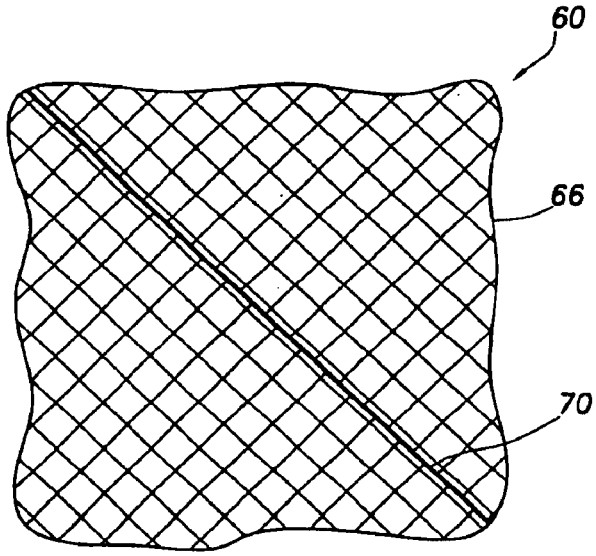
FIG. 6 is an enlarged scale view of a portion of the second well screen.

Referring additionally now to FIG. 6, an enlarged view of a portion of the well screen 60 (indicated by the encircled area designated by the reference number 6 in FIG. 5) is representatively illustrated. In this view a connection between adjacent wraps of the filtering media 66 may be seen. Specifically, the connection is a welded seam 70 between the filtering media 66 wraps. The seam 70 extends helically about the base pipe longitudinal axis 64.

Figure 7:
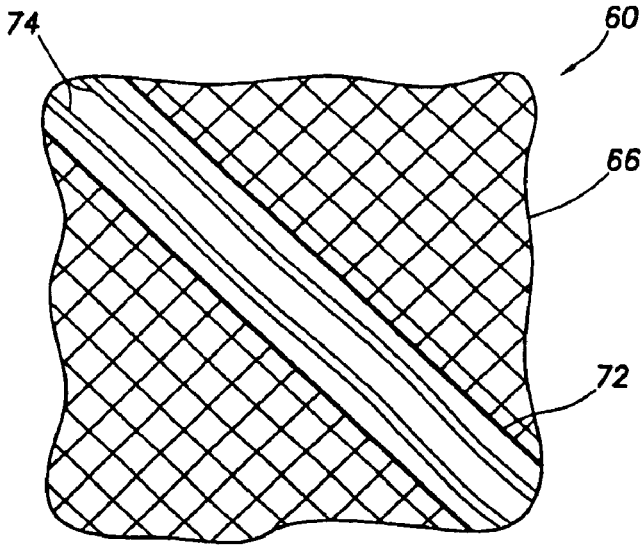
FIG. 7 is an enlarged scale view of an alternate configuration of the portion of the second well screen.

Referring additionally now to FIG. 7, an alternate connection between adjacent wraps of the filtering media 66 may be seen. Instead of welding the filtering media 66 wraps to each other, a connector 72 is welded between adjacent wraps. The connector 72 extends helically about the base pipe longitudinal axis 64.

Note that the connector 72 spaces apart the adjacent filtering media 66 wraps. This spacing apart of the filtering media 66 wraps provides a convenient location for lines 74 extending from one end to the other on the well screen 60. The lines 74 may include one or more of a hydraulic line for delivering and/or returning fluid and/or fluid pressure downhole, a chemical injection line, an electric line for communicating data or transmitting power downhole, a communication line, such as a fiber optic cable, etc. Any other type of line may be used as one or more of the lines 74 in keeping with the principles of the present invention.

The lines 74 are depicted in FIG. 7 as being externally disposed relative to the connector 72, but it is to be understood that the lines may be otherwise positioned. For example, the lines 74 could be positioned beneath the connector 72, the lines could extend through a hollow connector, etc.

Figure 8A:
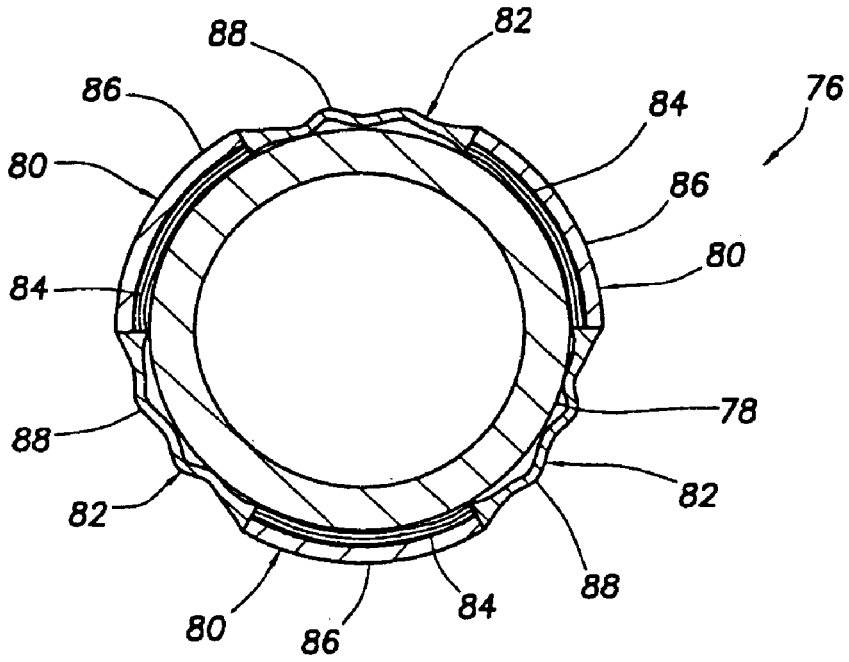
FIGS. 8A & 8B are cross-sectional views of a third expandable well screen embodying principles of the present invention.
Figure 8B:
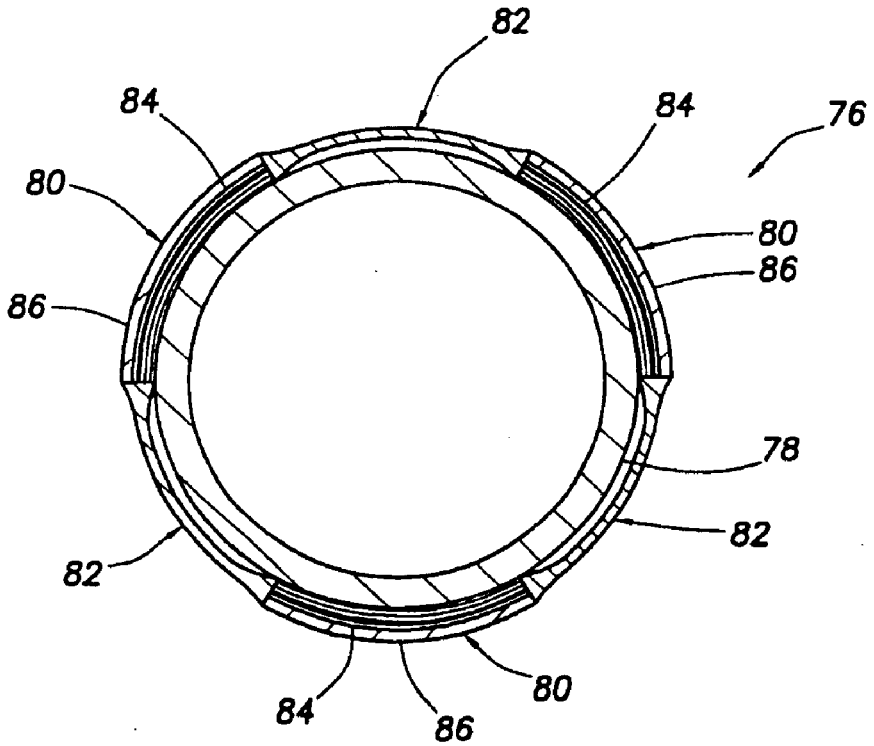

Referring additionally now to FIGS. 8A & B, another well screen 76 embodying principles of the present invention is representatively illustrated. In FIG. 8A, the well screen 76 is depicted as it is conveyed into a well. In FIG. 8B, the well screen 76 is depicted after a base pipe 78 thereof has been radially outwardly extended.

The well screen 76 includes the base pipe 78 with interconnected circumferentially alternating filtering portions 80 and expansion portions 82 outwardly overlying the base pipe. The filtering portions 80 each include an elongated strip of filtering media 84 and an elongated shroud strip 86 outwardly overlying the filtering media. The filtering media 84 may be similar to the filtering media 40 described above, or it may be another type of filtering media. The expansion portions 82 may be made of a suitable deformable material and, as depicted in FIG. 8A, may include longitudinally extending corrugations 88 formed thereon to facilitate circumferential lengthening of the expansion portions.

In FIG. 8B it may be seen that the expansion portions 82 have been lengthened circumferentially relative to the base pipe 78 as the base pipe has been radially outwardly extended. This increase in the circumferential lengths of the expansion portions 82 has increased the circumferential separation between the filtering portions 80, thereby permitting radially outward displacement of the filtering portions, without requiring substantial stretching, lengthening, or other deformation of the filtering media 84, and thus preventing damage to the filtering media.

The expansion portions 82 may be otherwise configured, without departing from the principles of the present invention. For example, the expansion portions 82 may be made of a material which is readily stretched, without the need of forming corrugations, folds, etc. thereon, the expansion portions may be otherwise lengthened, such as by using telescoping members, etc.

Furthermore, the expansion portions 82 may be physically connected to the filtering portions 80 in any manner, without departing from the principles of the present invention. For example, the expansion portions 82 may be attached directly to the filtering medias 84 and/or directly to the shrouds 86, or to another structure of the filtering portions, etc. It also is not necessary for only one of the expansion portions 82 to be interconnected between only two of the filtering portions 80.

Figure 9A:
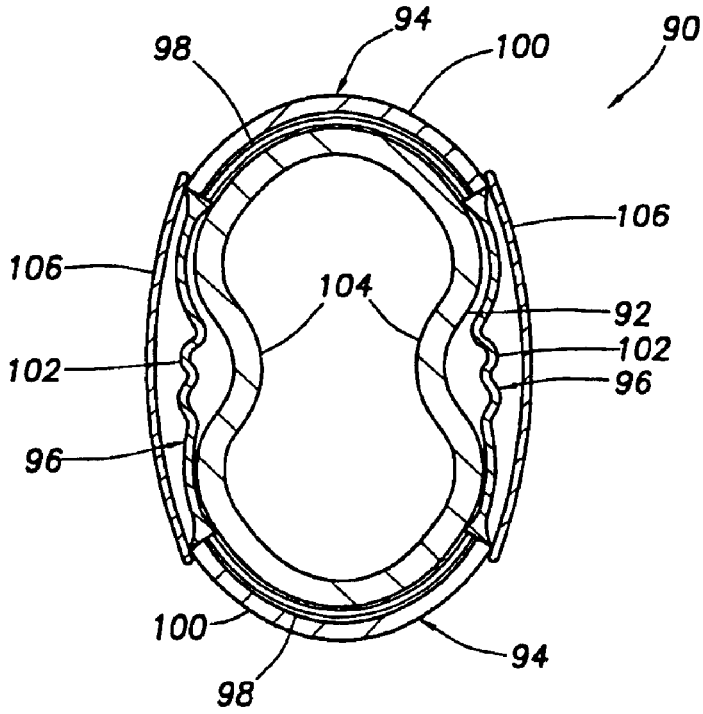
FIGS. 9A & 9B are cross-sectional views of a fourth expandable well screen embodying principles of the present invention.
Figure 9B:
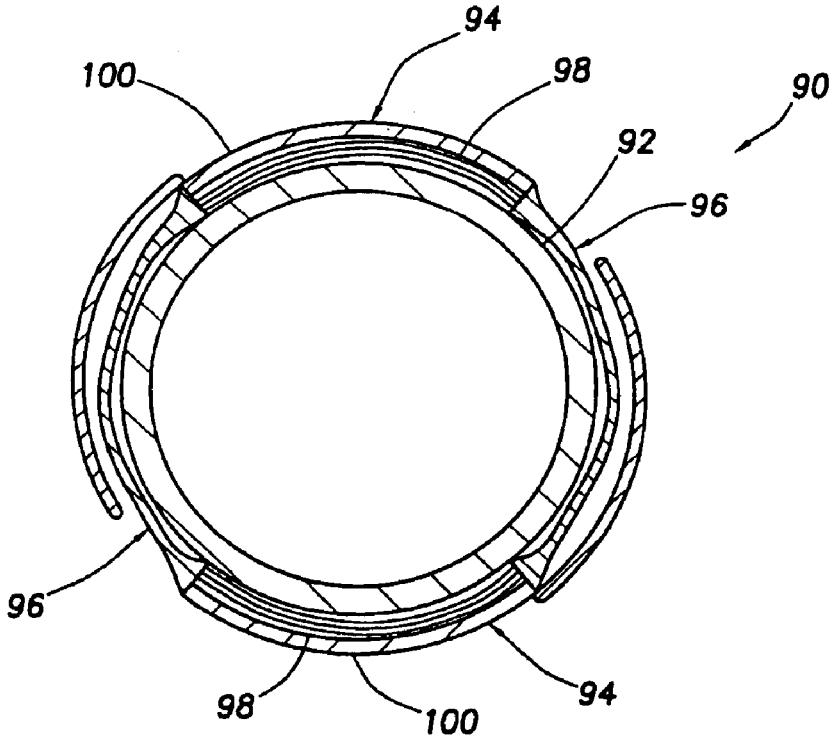

Referring additionally now to FIGS. 9A & B, another well screen 90 embodying principles of the present invention is representatively illustrated. The well screen 90 is depicted in FIG. 9A in a radially compressed configuration in which it is conveyed in a well. The well screen 90 is depicted in FIG. 9B in a radially expanded configuration.

Note that the well screen 90 is similar in many respects to the well screen 76 described above, in that it includes a base pipe 92 with circumferentially alternating filtering portion strips 94 and expansion portion strips 96 outwardly overlying the base pipe. The filtering portions 94 include filtering media 98 and shroud 100 strips similar to those described above, and the expansion portions 96 have longitudinally extending corrugations 102 formed thereon.

However, in the radially compressed configuration of the well screen 90, the base pipe 92 has longitudinally extending corrugations or undulations 104 formed thereon which radially reduce the size of the base pipe. The undulations 104 give the base pipe 92 an hourglass-shaped cross-section as depicted in FIG. 9A. When the base pipe 92 is radially outwardly extended, the undulations 104 are substantially eliminated, as are the corrugations 102 of the expansion portions 96, and the filtering portions 94 are radially outwardly displaced.

Another difference between the well screens 76, 90 is that the well screen 90 includes retaining members 106 securing the expansion strips 96 in compressed configurations thereof, as depicted in FIG. 9A. When the base pipe 92 is radially outwardly extended, the retaining members 106 release, thereby permitting the expansion strips 96 to circumferentially lengthen relative to the base pipe, as depicted in FIG. 9B. In the compressed configuration of the well screen 90, each of the retaining members 106 may be attached between two of the shroud strips 100.

Figure 10A:
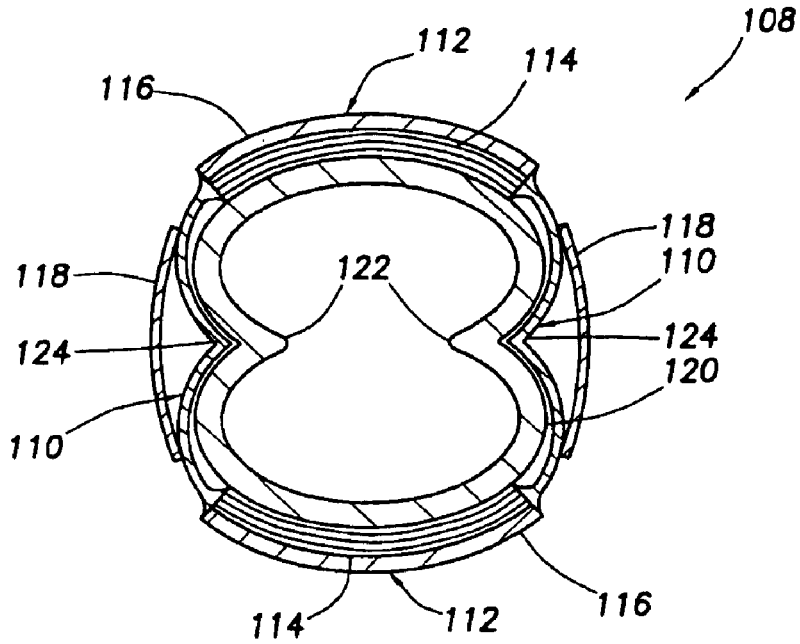
FIGS. 10A & 10B are cross-sectional views of a fifth expandable well screen embodying principles of the present invention.
Figure 10B:
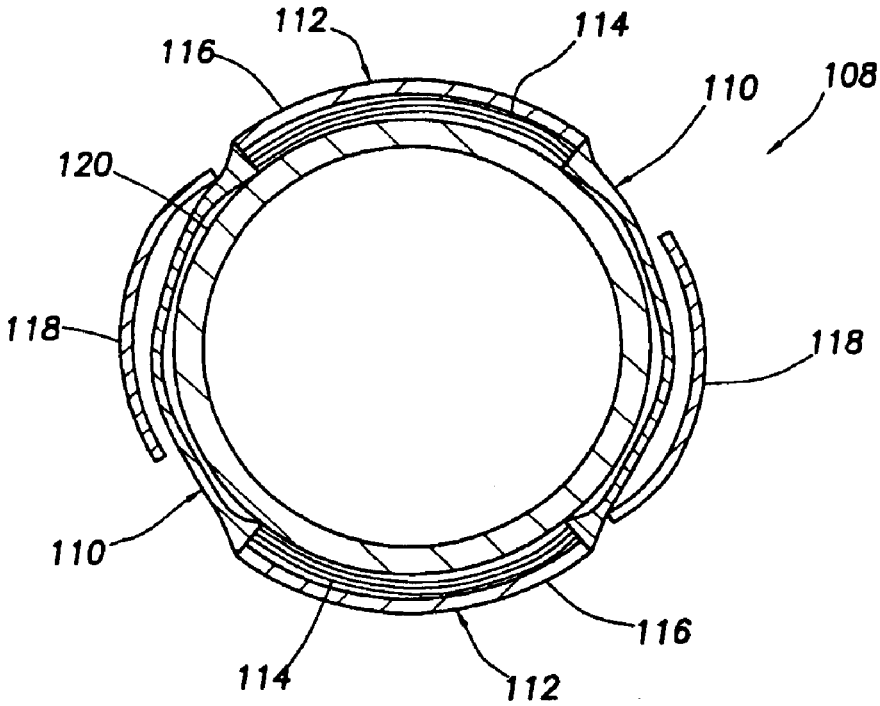

Referring additionally now to FIGS. 10A & B, another well screen 108 embodying principles of the present invention is representatively illustrated. The well screen 108 is depicted in a radially compressed configuration in FIG. 10A, in which the well screen is conveyed in a well. In FIG. 10B, the well screen 108 is depicted in a radially expanded configuration.

The well screen 108 is very similar to the well screen 90 described above, in that it includes a base pipe 120 and circumferentially alternating strips of expansion portions 110 and filtering portions 112. The filtering portions 112 each include a filtering media strip 114 and an external shroud strip 116. The filtering media 114 may be similar to the filtering media 40 described above. The expansion portions 110 are interconnected between the filtering portions 112. A retaining member 118 secures each expansion portion 110 in a compressed configuration until the base pipe 120 is radially outwardly expanded.

However, in the well screen 108, the base pipe 120 has longitudinally extending folds 122 formed thereon in the radially compressed configuration of the well screen. The expansion portions 110 also have longitudinally extending folds 124 formed thereon. When the base pipe 120 is radially expanded, the folds 122, 124 are partially or completely eliminated, as depicted in FIG. 10B.

Note also that the retaining members 118 are interconnected between opposite circumferential ends of each of the expansion portions 110 (see FIG. 10A), instead of being interconnected to the expansion portions 112. When the base pipe 120 is radially expanded, the retaining members 118 release and permit the expansion portions 110 to "unfold" or otherwise lengthen circumferentially.

Figure 11:
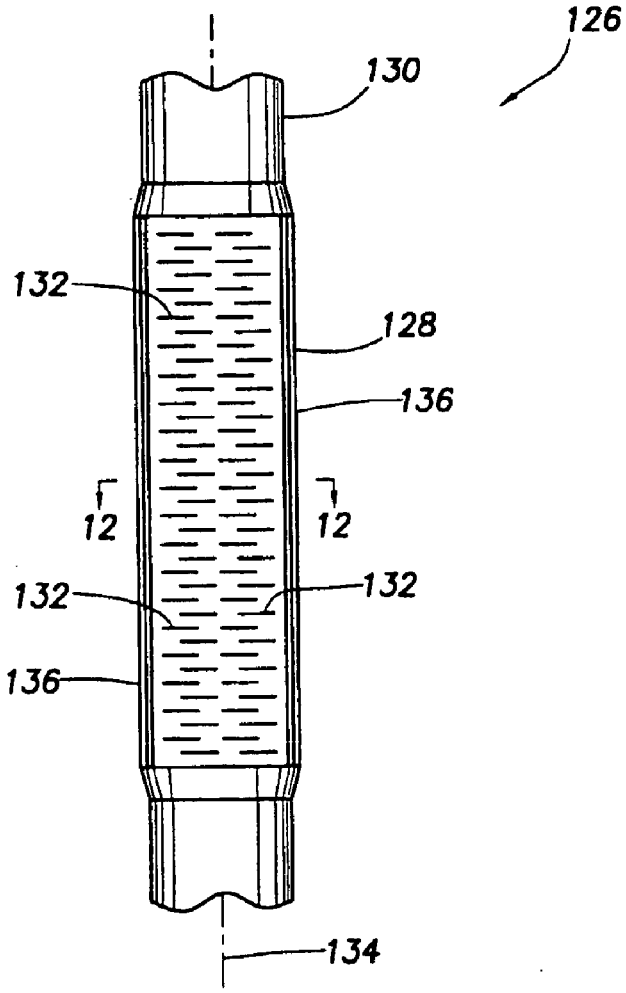
FIG. 11 is an elevational view of a sixth expandable well screen embodying principles of the present invention.

Referring additionally now to FIG. 11, another well screen 126 embodying principles of the present invention is representatively illustrated. The well screen 126 includes a filtering media 128 outwardly overlying a generally tubular base pipe 130. The filtering media 128 is depicted as a generally tubular structure having circumferentially extending slots 132 formed therethrough, with the slots being helically arranged relative to a longitudinal axis 134 of the base pipe. Of course, the filtering media 128 may be otherwise constructed, without departing from the principles of the present invention.

The filtering media 128 is preferably made of a suitable durable and deformable material, such as steel, through which the slots 132 may be readily formed, such as by laser machining, water cutting, etc. Alternatively, each of the slots 132 could instead be a row of closely spaced small diameter holes (for example, having a diameter of approximately 0.008 in. and spaced approximately 0.016 in. apart). The slots or holes 132 are used to filter fluid flowing inwardly through the filtering media 128.

Figure 12:
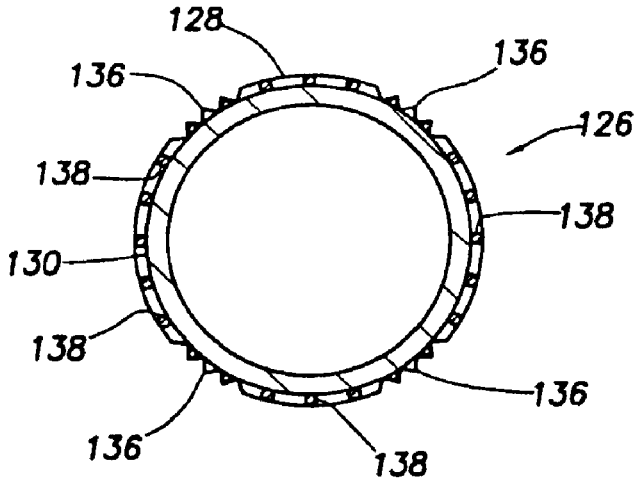
FIG. 12 is a cross-sectional view of the sixth expandable well screen, taken along line 12—12 of FIG. 11.

The filtering media 128 has corrugations or pleats 136 formed thereon. The pleats 136 may be seen in FIG. 12, which is a cross-sectional view of the well screen 126, taken along line 12—12 of FIG. 11. The pleats 136 permit the filtering media 128 to lengthen circumferentially when the base pipe 130 is expanded radially outward, without substantially stretching the filtering media material.

A series of circumferentially spaced apart and longitudinally extending rods or ribs 138 is disposed radially between the filtering media 128 and the base pipe 130. Some of the ribs 138 may be positioned between the pleats 136 and the base pipe 130. The ribs 138 aid in radially outwardly displacing the filtering media 128 when the base pipe 130 is radially expanded. In addition, the ribs 138 provide for transverse flow of fluid between the filtering media 128 and the base pipe 130. Thus, fluid flowing inwardly through one of the slots 132 may then flow transversely between the filtering media 128 and the base pipe 130 before flowing into the base pipe through an opening (not shown) formed through a sidewall of the base pipe.

Note that the ribs 138 may be otherwise disposed between the filtering media 128 and the base pipe 130, while still outwardly supporting the filtering media and providing for transverse flow of fluid between the filtering media and the base pipe. For example, the ribs 138 could be helically disposed relative to the base pipe 130. As further alternatives, the ribs 138 could be replaced by a layer of the relatively coarse woven material 52 described above, transverse fluid flow may be provided by the grooves or recesses 55, 57 described above formed on the base pipe 130, etc.

Figure 13:
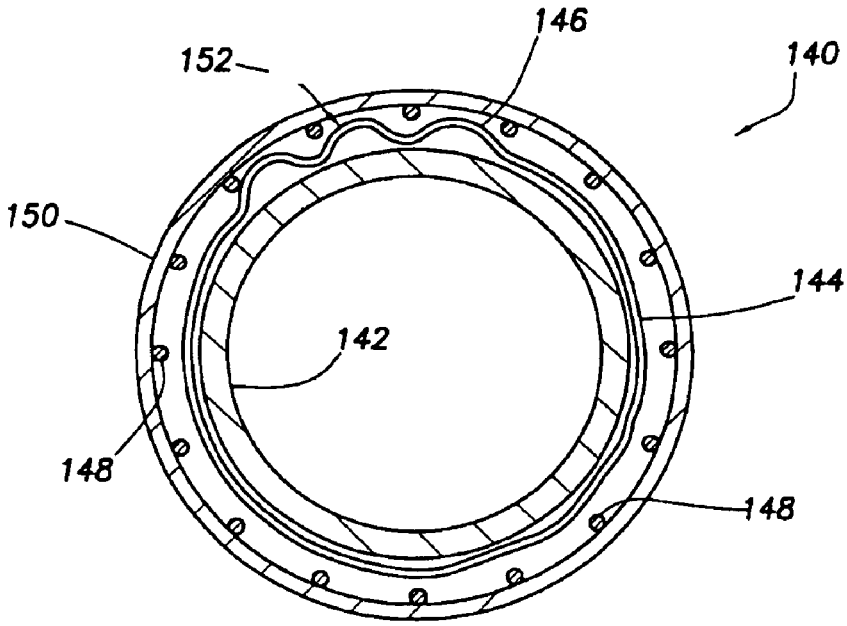
FIG. 13 is a cross-sectional view of a seventh expandable well screen embodying principles of the present invention.

Referring additionally now to FIG. 13, another well screen 140 embodying principles of the present invention is representatively illustrated. The well screen 140 is similar to the well screen 126 described above in that it includes a generally tubular base pipe 142, a filtering media 144 outwardly overlying the base pipe 142 and longitudinally extending and circumferentially spaced apart ribs 148. The filtering media 144 may be similar to the filtering media 40 described above.

However, in the well screen 140, a generally tubular outer protective shroud 150 envelopes the filtering media 144, and the ribs 148 are positioned between the filtering media and the shroud. Since the ribs 148 provide for transverse fluid flow between the shroud 150 and the filtering media 144, the outer layer of the filtering media (see outer layer 48 in FIG. 2) may not be used. Additionally, pleats or corrugations 146 are formed on an elongated expansion portion 152 interconnected between circumferential ends of the filtering media 144.

When the base pipe 142 is radially expanded, the corrugations 146 are fully or at least partially extended, thereby circumferentially lengthening the expansion portion 152 and permitting the filtering media 144 to be radially outwardly displaced without requiring substantial stretching of the filtering material.

Figure 14:
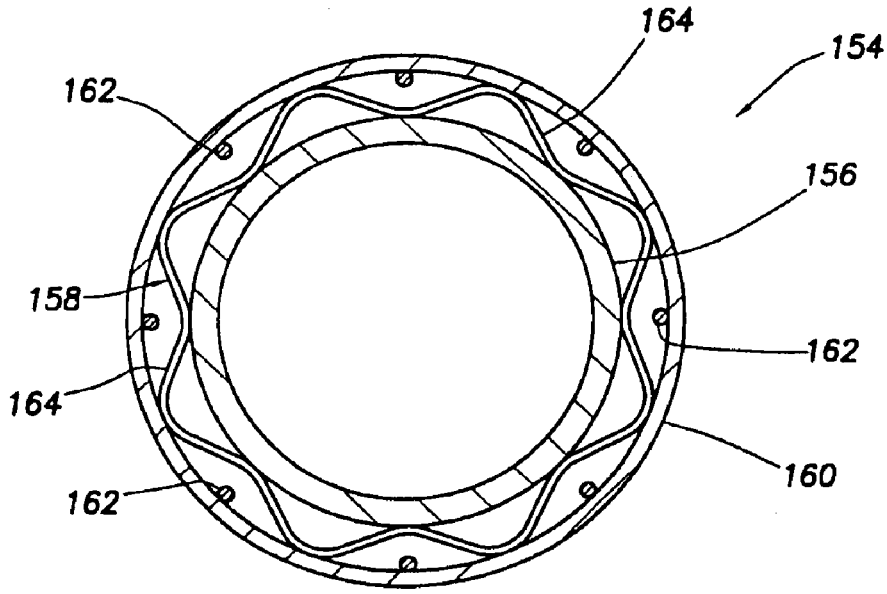
FIG. 14 is a cross-sectional view of an eighth expandable well screen embodying principles of the present invention.

Representatively illustrated in FIG. 14 is another well screen 154 embodying principles of the present invention. The well screen 154 is very similar to the well screen 140 described above, in that it includes a generally tubular base pipe 156, a filtering media 158 outwardly overlying the base pipe, an outer protective shroud 160 and ribs 162 extending longitudinally between the shroud and the filtering media.

The filtering media 158 may be similar to the filtering media 40 described above, with the exception that it may not include the outer relatively coarse layer of filtering material 48, since the ribs 162 should provide for transverse flow of fluid between the shroud 160 and the filtering media.

However, instead of the expansion portion 152 of the well screen 140, the well screen 154 differs in that its filtering media 158 has longitudinally extending corrugations 164 formed directly thereon. When the base pipe 156 is radially expanded, the corrugations 164 are fully or at least partially straightened, thereby circumferentially lengthening the filtering media 158 and permitting it to be radially outwardly displaced without substantially stretching the filtering material.

Figure 15:
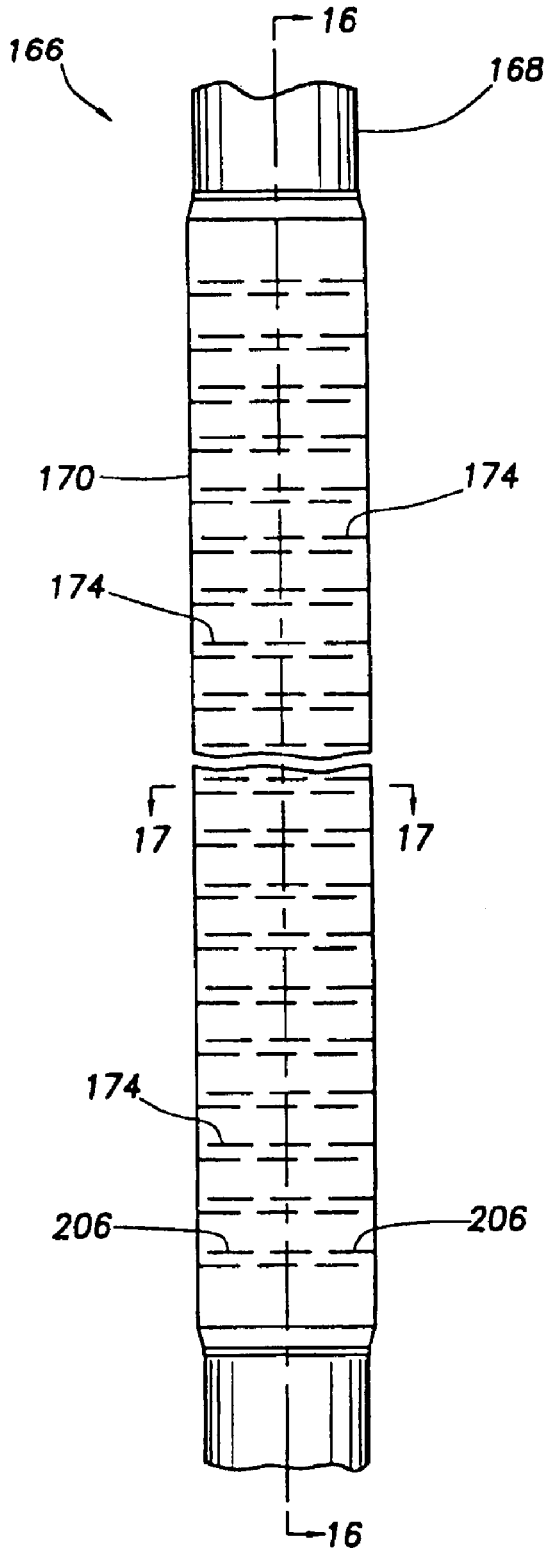
FIG. 15 is an elevational view of a ninth expandable well screen embodying principles of the present invention.
Figure 16:
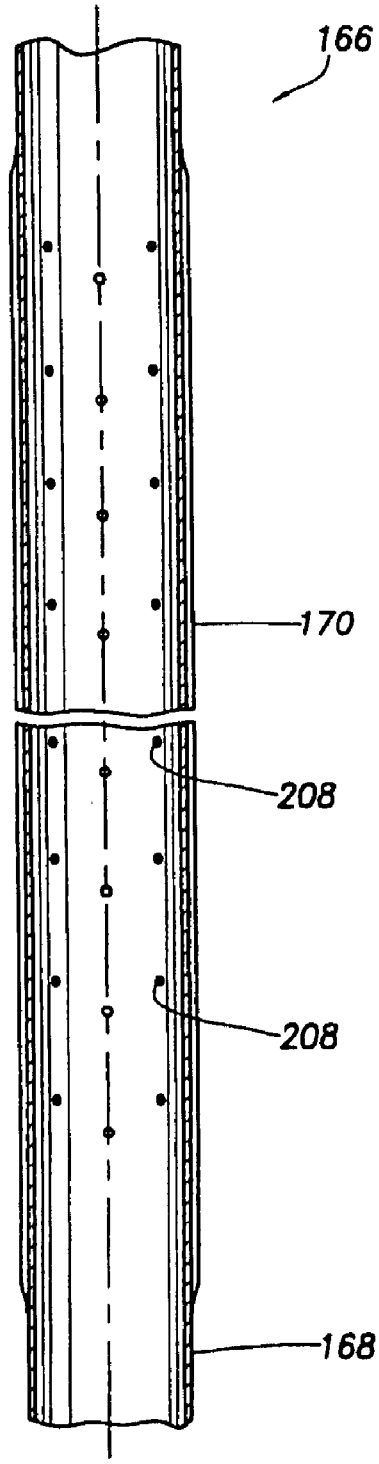
FIG. 16 is a cross-sectional view of the ninth well screen, taken along line 16—16 of FIG. 15.
Figure 17:
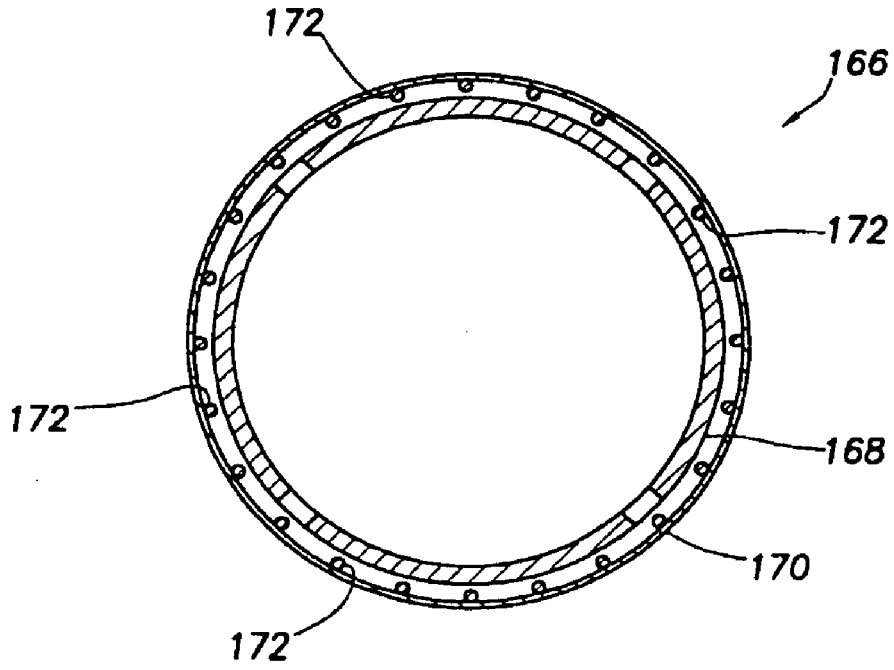
FIG. 17 is an enlarged scale cross-sectional view of the ninth well screen, taken along line 17—17 of FIG. 15.

Referring additionally now to FIGS. 15–17, another well screen 166 embodying principles of the present invention is representatively illustrated. The well screen 166 is shown in an elevational view in FIG. 15, in a cross-sectional view in FIG. 16 taken along longitudinal line 16—16 of FIG. 15, and in an enlarged cross-sectional view in FIG. 17 taken along lateral line 17—17 of FIG. 15.

The well screen 166 is similar in some respects to the well screen 126 described above, in that it includes a generally tubular base pipe 168, a generally tubular and laterally slotted filtering media 170 outwardly overlying the base pipe, and a series of circumferentially spaced apart longitudinally extending ribs 172 disposed between the filtering media and the base pipe. Slots 174 in the filtering media 170 extend laterally, are arranged in series extending helically about the base pipe 168, are used to filter fluid flowing therethrough, and may be replaced by rows of relatively small diameter closely spaced holes as described above for the slots 132.

Figure 18:
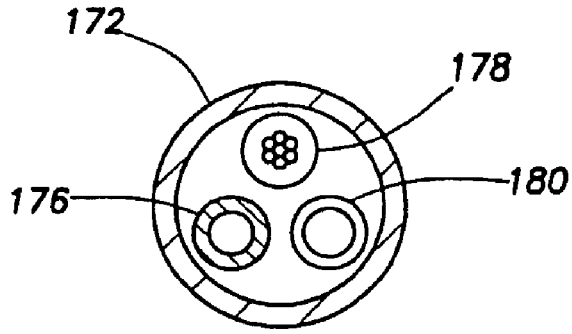
FIG. 18 is an enlarged scale view of a portion of the ninth well screen.

However, the well screen 166 differs in some respects from the previously described well screen 126 in that one or more of the ribs 172 may be hollow and may have lines extending therethrough, and the filtering media 170 does not include the pleats 136. An enlarged scale cross-sectional view of one of the ribs 172 is shown in FIG. 18, wherein it may be seen that a hydraulic or chemical injection line 176, an electrical line 178 and a fiber optic line 180 extend through the hollow rib. These lines may be used to power equipment in a well below the well screen 166, communicate with tools in the well, etc., and it is to be clearly understood that any type of line may be used without departing from the principles of the present invention.

Another useful purpose for the hollow ribs 172 is to prevent excessive expansion force from being imparted to the filtering media 170. For example, when the base pipe 168 is radially outwardly expanded, the expansion force used to expand the base pipe is transmitted via the ribs 172 to the filtering media 170. The ribs 172 are compressed between the base pipe 168 and the filtering media 170 by the expansion force and, if the expansion force is excessive, the ribs will collapse, thereby preventing the excessive force from being transmitted to the filtering media. This collapse of the ribs 172 may be useful in preventing damage to the filtering media 170 so that the well screen 166 may still be used, even though an excessive expansion force has been applied to the base pipe 168.

Note that the slots 174 will decrease in width when the base pipe 168 is radially expanded. This is due to the fact that the filtering media 170 is axially shortened somewhat when it is radially expanded, due to the filtering media being stretched circumferentially. Preferably, the filtering media 170 filters particles greater than 500 μm from the fluid flowing therethrough (i.e., the slots 174 have a width of less than or equal to 500 μm) when the well screen 166 is radially expanded. In addition, it is preferred that the width of the slots 174 decrease less than fifty percent when the well screen 166 is radially expanded.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A well screen for use in a subterranean wellbore, comprising:

the screen having radially unextended and radially expanded configurations in the wellbore; and at least one line extending longitudinally through the screen when the screen is in Its expanded configuration in the wellbore, wherein a filtering media is wrapped helically about a base pipe of the screen.

2. The screen according to claim 1, wherein the line extends between edges of the filtering media.

3. The screen according to claim 1, wherein the filtering media Includes multiple layers of filtering material.

4. A well screen for use in a subterranean wellbore, comprising:

the screen having radially unextended and radially expanded configurations in the wellbore; and at least one line extending longitudinally through the screen when the screen is in its expanded configuration in the wellbore, wherein the line extends helically about a base pipe of the screen.

5. A well screen for use in a subterranean wellbore, comprising:

the screen having radially unextended and radially expanded configurations in the wellbore; and at least one line extending longitudinally through the screen when the screen is in its expanded configuration in the wellbore, wherein the line extends external to a connector joining edges of a filtering media of the screen.

6. A well screen for use in a subterranean wellbore, comprising:

the screen having radially unextended and radially expanded configurations in the wellbore; and at least one line extending longitudinally through the screen when the screen is in its expanded configuration in the wellbore, wherein the line extends inwardly of a connector joining edges of a filtering media of the screen.

7. A well screen for use in a subterranean wellbore, comprising:

the screen having radially unextended and radially expanded configurations in the wellbore; and at least one line extending longitudinally through the screen when the screen is in its expanded configuration in the wellbore, wherein the line extends within a hollow connector joining edges of a filtering media of the screen.

8. A well screen for use in a subterranean wellbore, comprising:

the screen having radially unextended and radially expanded configurations in the wellbore; and at least one line extending longitudinally through the screen when the screen is in its radially unextended and radially expanded configurations in the wellbore, wherein the line provides fluid communication between a well tool and a remote location.

9. A well screen for use in a subterranean wellbore, comprising:

the screen having radially unextended and radially expanded configurations in the wellbore; and at least one line extending longitudinally through the screen when the screen is in its radially unextended and radially expanded configurations in the wellbore, wherein the line provides data communication between a well tool and a remote location.

10. A well screen for use in a subterranean wellbore, comprising:

the screen having radially unextended and radially expanded configurations in the wellbore; and at least one line extending longitudinally through the screen when the screen is in its radially unextended and radially expanded configurations in the wellbore, wherein the line provides electrical power between a well tool and a remote location.

11. A well screen for use in a subterranean wellbore, comprising:

the screen having radially unextended and radially expanded configurations in the wellbore; and at least one line extending longitudinally through the screen when the screen is in its radially unextended and radially expanded configurations in the wellbore, wherein the line transmits treatment chemicals between a well tool and a remote location.

12. A well screen for use in a subterranean wellbore, comprising:

the screen having radially unextended and radially expanded configurations in the wellbore; and a filtering media including generally circumferentially extending slots therethrough when the screen is in its expanded configuration in the wellbore, the slots being formed in a single structure which extends circumferentially continuously on the screen through a closed path.

13. The screen according to claim 12, wherein the filtering media is circumferentially lengthened, without stretching a filtering material of the filtering media, when the screen is expanded from its unextended configuration to its expanded configuration.

14. The screen according to claim 12, wherein a relatively coarse woven material of the filtering media provides for transverse fluid flow between the filtering media and a base pipe of the screen.

15. The screen according to claim 12, wherein a relatively coarse woven material of the filtering media provides for transverse fluid flow between the filtering media and an outer protective shroud of the screen.

16. The screen according to claim 12, wherein the slots extend circumferentially relative to a longitudinal axis of a tubular base pipe of the screen, the filtering media being outwardly positioned relative to the base pipe.

17. A well screen for use in a subterranean wellbore, comprising:

the screen having radially unextended and radially expanded configurations in the wellbore; and a filtering media including generally circumferentially extending slots therethrough when the screen is in its expanded configuration in the wellbore, wherein the slots are helically distributed relative to a longitudinal axis of a base pipe of the screen.

18. A well screen for use in a subterranean wellbore, comprising:

the screen having radially unextended and radially expanded configurations in the wellbore; and a filtering media including generally circumferentially extending slots therethrough when the screen is in its expanded configuration in the wellbore, wherein the filtering media includes corrugations formed between the slots.

19. A well screen for use in a subterranean wellbore, comprising:

the screen having radially unextended and radially expanded configurations in the wellbore; and a filtering media including generally circumferentially extending slots therethrough whose dimensions are substantially altered when the screen is in its expanded configuration in the wellbore, wherein recesses formed on a base pipe of the screen provide for transverse fluid flow between the filtering media and the base pipe.

20. A well screen for use in a subterranean wellbore, comprising:

the screen having radially unextended and radially expanded configurations in the wellbore; and a filtering media including generally circumferentially extending slots therethrough whose dimensions are substantially altered when the screen is in its expanded configuration in the wellbore, wherein recesses formed on an outer protective shroud of the screen provide for transverse fluid flow between the filtering media and the shroud.

* * * * *